United States Patent [19]

Takegawa et al.

[11] Patent Number: 4,531,557

[45] Date of Patent: Jul. 30, 1985

[54] WEFT RESERVOIR FOR FLUID JET LOOMS

[75] Inventors: Yujiro Takegawa, Uchinada; Kanji Tsuji, Kanazawa, both of Japan

[73] Assignee: Tsudakoma Kogyo Kabushiki Kaisha, Japan

[21] Appl. No.: 508,857

[22] Filed: Jun. 29, 1983

[30] Foreign Application Priority Data

Jul. 2, 1982 [JP] Japan ..... 57-115029

[51] Int. Cl.[3] ..... D03D 47/36

[52] U.S. Cl. ..... 139/452; 242/47.01

[58] Field of Search ..... 139/452; 262/47.01, 262/47.12; 66/132 R

[56] References Cited

U.S. PATENT DOCUMENTS 3,971,522 7/1976 Pfarrwaller ..... 139/452 X
4,226,379 10/1980 Brouwer et al. ..... 139/452 X
4,372,349 2/1983 Van Mullerom ..... 139/452
4,386,633 6/1983 Shin ..... 139/452

FOREIGN PATENT DOCUMENTS 58-70747 4/1983 Japan ..... 139/452

*Primary Examiner*—James Kee Chi
*Attorney, Agent, or Firm*—Ostrolenk, Faber, Gerb & Soffen

[57] ABSTRACT

On a drum-type weft reservoir for fluid jet looms, a single control pin used for control of reservation and delivery of weft is kept, without any detection of unwind of weft under delivery, away from engagement with weft on a reservoir drum over a period of a length necessary for delivery of weft for one cycle of weft insertion, preferably in combinating with an expedient for barring accidental slip-out of weft under delivery.

11 Claims, 4 Drawing Figures

WEFT RESERVOIR FOR FLUID JET LOOMS

BACKGROUND OF THE INVENTION

The present invention relates to a weft reservoir for fluid jet looms, and more particularly relates to an improvement in the construction and operation of a weft reservoir for fluid jet looms wherein the weft is wound about a reservoir drum including conical and cylindrical sections through relative rotation between a yarn guide and the reservoir drum, reserved thereon and delivered therefrom for weft insertion under pin control.

In the following description, the side of the arrangement closer to the supply source of the weft is referred to in general as "the upstream side" whereas the side of the arrangement closer to the main jet nozzle for insertion of the weft is referred to in general as "the downstream side".

Weft reservation under pin control on a weft reservoir is roughly classified into two major types. In the first type of weft reservation, coils of weft for different cycles of weft insertion are separately reserved by cooperation of two or more control pins and, as a result of inter-pin assignment, are moved downstream on the reservoir drum. At the moment of weft insertion, coils of weft for that cycle of weft insertion are released by hold of the most downstream side control pin for delivery from the reservoir drum. In the case of this type, coils of weft for different cycles of weft insertion can be reserved in a fairly separated state and delivered quite independently of each other. But this type of weft reservation requires use of a relatively complicated mechanism to assure exactly phased movements of the control pins for proper inter-pin assignment of the weft and opportune release of weft for delivery.

In the second type of weft reservation, a sufficiently large number of coils of weft are reserved on the reservoir drum without any clear separation with use of a single control pin in engagement with the most downstream coil of weft. At the moment of weft insertion, the control pin is retained out of engagement with the weft, which is then subjected to delivery from the reservoir drum. When coils of weft for one cycle of weft insertion have been delivered from the reservoir drum, the control pin is brought into engagement with the most downstream coil of weft remaining on the reservoir drum. This type of weft reservation avoids the necessity for separate reservation of weft by two or more control pins. In addition, this type of weft reservation is very advantageous from the viewpoint of stable reservation of weft on the reservoir drum. The larger the number of coils of weft wound on the reservoir drum, the smaller the possibility of undesirable, accidental, slip-out of weft from the reservoir drum during the delivery of weft for weft insertion. Apparently such slip-out of weft lends to superfluous delivery of weft at that cycle of weft insertion and, further, to insufficient delivery of weft for the next cycle of weft insertion. Such slip-out of weft also tends to cause undesirable slippage of the weft on the reservoir drum in particular at the starting period of winding, which disables the reservation of the correct number of coils of weft for the next cycle of weft insertion. Despite such advantages, it is prerequisite to this type of weft reservation to provide a special expedient such as a photo-electric system to detect the number of coils of weft to be unwound from the reservoir drum during the delivery for weft insertion. In addition, the result of such detection has to be properly processed in order to incite a corresponding mechanical movement of the control pin. This also requires use of another complicated mechanism.

It is therefore strongly desirable to practice the above-described second type of weft reservation without complicating the mechanism of the weft reservoir involved.

Even when this requirement is satisfied and a control pin is very timely registered at its operative position for engagement with weft on the cylindrical section of a weft reservoir, the conventional construction of the weft reservoir, i.e. the uniform diameter of the cylindrical section for reservation of weft, cannot assure perfect prevention of the above-described accidental slip-out of weft at delivery.

It is then also required to provide a reliable expedient to prevent accidental slip-out of weft at delivery.

Aside from these requirements for a simple mechanism and stable the weft delivery without accidental slip-out of weft at delivery, care should be directed to the fact that operation of the control pin, more specifically maintaining control pin at its stand-by position, is closely related to the associated running of the loom, and that, as long as the main jet nozzle is in operation, coils of weft are freely delivered from the reservoir drum when the control pin is maintained at its stand-by position out of engagement with the weft under delivery. As explained already, the control pin is brought back to its operative position in engagement with the weft at a moment when coils of weft for one cycle of weft insertion have been delivered from the reservoir coil as long as normal loom operation continues.

Trouble starts when the loom stops running due to some accident such as yarn breakage in particular at the very moment of weft insertion. Coils of weft on the reservoir drum are delivered therefrom due to traction of the main jet loom in operation since the control pin has already been moved to the stand-by position out of engagement with the weft under delivery. Delivery of weft goes on but the control pin isn't brought back to the operative position since its operation is closely related to the running of the loom which has already stopped. As a consequence, more coils of weft are delivered than necessary for one cycle of weft insertion, which apparently causes insufficient weft delivery for the next cycle of weft insertion.

It is therefore strongly required that excessive delivery of weft should be prevented even when the loom stops its normal running even at the very moment of weft insertion.

SUMMARY OF THE INVENTION

It is the basic object of the present invention to provide a weft reservoir of a simple construction which allows reservation of sufficient number of coils of weft and delivery of weft exactly necessary for one cycle of weft insertion through use of a single control pin only.

It is another object of the present invention to provide a weft reservoir which further reliably prevents accidental slip-out of weft at delivery.

It is the other object of the present invention to provide a weft reservoir which restricts delivery of weft in excess of amount necessary for one cycle of weft insertion regardless of loom running condition.

In accordance with the basic aspect of the present invention, the weft reservoir includes a reservoir drum which includes an upstream side conical section converging downstream and a downstream side cylindrical section, a control pin is annexed to the reservoir drum with its point being directed to an operative position taken on the outer periphery of the reservoir drum on the downstream side of the cylindrical section, and the control pin is kept at a standby position away from the operative position over a period necessary for delivery of weft for one cycle of weft insertion.

In accordance with another aspect of the present invention, the weft reservoir is additionally provided with means for bar-ring accidental slip-out of weft at delivery from the reservoir drum which is arranged on the downstream side of the operative position for the control pin. In a typical embodiment of this aspect, the barring means includes a second conical section diverging downstream which is formed on the downstream side of the cylindrical section of the reservoir drum.

In accordance with the other aspect of the present invention, the weft reservoir is further provided with means for restricting delivery of weft in excess of the amount necessary for one cycle of weft insertion regardless of loom running condition. In a typical embodiment of this aspect, the restricting means includes an auxiliary control pin accompanying the control pin.

DESCRIPTION OF THE PREFERRED EMBODIMENTS

Figure 1:
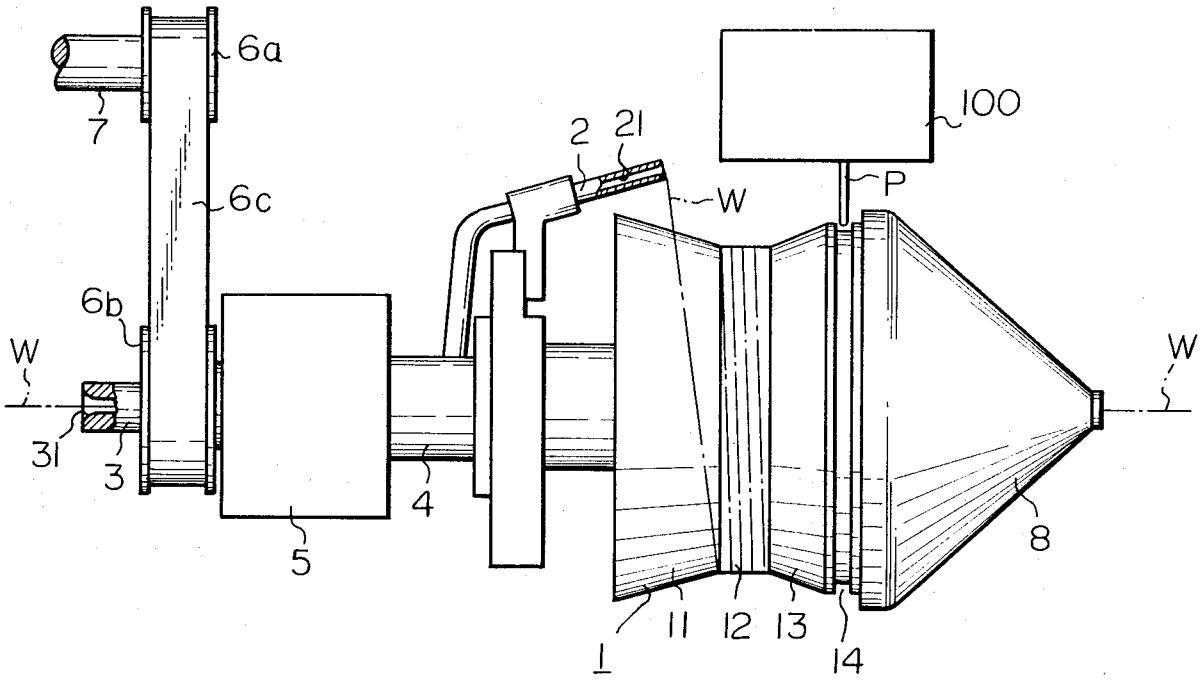
FIG. 1 is a side view of one embodiment of the weft reservoir in accordance with the present invention.

One embodiment of the weft reservoir in accordance with the present invention is shown in FIG. 1, in which a stationary reservoir drum is used in combination with a rotary yarn guide. Needless to say, the present invention is well applicable to other types of weft reservoirs as long as weft taken from a given source of supply is supplied onto a reservoir drum through relative rotation between the reservoir drum and an annexed yarn guide. In one example, a stationary yarn guide may be combined with a rotary reservoir drum. In another example, a yarn guide and a reservoir drum may be both driven for rotation at different speeds. In the other example, an additional rotary guide may be used for reservation of weft on a reservoir drum.

The weft reservoir includes a stationary reservoir drum 1, a yarn guide 2 concentrically rotatable about the reservoir drum 1, a control pin P with its point being directed to the outer periphery of the reservoir drum 1 and a pin drive unit 100 arranged in a fixed relationship with respect to the reservoir drum 1. In this case, the pin drive unit 100 is arranged outside the reservoir drum 1 so that the control pin P is driven for movement between the operative position on the outer periphery of the reservoir drum 1 and a stand-by position radially outward of the operative position. As a substitute, however, the pin drive unit 100 may be arranged inside the reservoir drum 1 so that the control pin P is driven for movement between the operative position and a standby position radially inward of the operative position.

The yarn guide 2 is secured to a main drive shaft 3 which extends through a tubular housing 4 in order to support the reservoir drum 1 via suitable bearings (not shown). The reservoir drum 1 is blocked against free rotation by means of a suitable latching mechanism such as a magnet system (not shown). The main drive shaft 3 is supported for rotation by a bracket 5 by means of suitable bearings (not shown). The main drive shaft 3 is provided with a driven pulley **6*b* secured thereon and connected to a drive pulley 6*a* secured on an intermediate shaft 7 by means of a transmission belt 6*c*. The intermediate shaft 7 is operationally connected to the drive shaft of the associated loom for synchronized rotation. The yarn guide 2 is provided with an axial bore 21 which communicates with an axial bore 31 in the main drive shaft 3**, both for passage of weft W.

The reservoir drum 1 in this embodiment includes the first conical section 11, converging in the downstream direction, a cylindrical section 12 formed on the downstream side of the first conical section 11 and the second conical section 13 diverging in the downstream direction and formed on the downstream side of the cylindrical section 12.

The weft W taken from a given source of supply (not shown) is brought to the outlet of the yarn guide 2 via the axial bores 31 and 21 and issued therefrom for reservation on the cylindrical section 12 of the reservoir drum 1. Presence of the second conical section 13 effectively prevents the of coils of weft from accidentally slipping out at delivery from the cylindrical section 12.

Any expedients may be substituted for the second conical section 13 diverging downstream as long as same effectively bars accidental slip-out of coils of weft at delivery. In one example, an annular brush may be arranged facing the outer periphery of the downstream end of the cylindrical section 12. In another example, the downstream end of the cylindrical section 12 may be encompassed by a circumferential covering to define an annular chamber in which an air flow is generated in order to press the weft under delivery onto the outer periphery of the cylindrical section 12.

A circumferential groove 14 is formed on the downstream side of the second conical section 13 in order to provide the operative position for the control pin P. More specifically, the point of the control pin P intrudes into the circumferential groove 14 when the control pin P is registered at the operative position being driven by the pin drive unit 100. In case of a weft reservoir employing a reservoir drum blocked against rotation, the circumferential groove may be replaced by a spot recess formed at a proper position in the outer periphery of the reservoir drum 1 corresponding to the operative position for the control pin P. In general, however, use of the above-described circumferential groove is rather advantageous since it allows slight rotation of the reservoir drum which may be conditionally caused by insufficient operation of the latching mechanism.

The weft reservoir further preferably includes a balloon breaker 8 arranged on its downstream end. This balloon breaker 8 effectively restricts radial expansion of the balloon of weft under delivery so that the weft W does not come into engagement with the control pin P kept at the stand-by position when the latter is moved radially outward from side of the operative zone on the outer periphery of the reservoir drum 1. The clearance between the inner wall of the balloon breaker 8 and the outer periphery of the reservoir drum 1 should preferably be as narrow as possible in order to minimize the path of travel of the control pin P. It is also preferable that the diameter of the balloon breaker 8 is freely adjustable in accordance with change in diameter of the reservoir drum 1.

In operation, the weft issued from the outlet of the yarn guide 2 winds about the first conical section 11 of the reservoir drum 1 and coils of weft automatically slide towards the cylindrical section 12 due to the converging construction of the first conical section 11. A sufficient number of coils of weft are thus reserved on the cylindrical section 12 with the most downstream coil of weft being in engagement with the control pin P now registered at the operative position. Delivery of weft is initiated when the control pin P is out of engagement with the weft, and continues as long as the control pin P is kept at the stand-by position out of engagement with the weft under delivery.

Obviously, the amount of weft to be delivered from the reservoir drum is proportional to the length of the period in which the control pin P is kept at the stand-by position away from the operative position. In accordance with the basic concept of the present invention, removal of the control pin P from the operative position and advance of the control pin P from the stand-by position are both timed so that the control pin P should stay out of any engagement with the weft under delivery over a period of a length necessary for delivery of weft for one cycle of weft insertion.

For example, if four coils of weft on the reservoir drum correspond to one cycle of weft insertion, the weft insertion starts at 90° crank cycle and terminates at 250° crank cycle, the fourth coil of weft will be fully unwound from the reservoir drum roughly at a moment between 220° and 230° crank angle. In this case, the operation of the control pin P should be timed to advance to the operative position in the circumferential groove 14 at a moment between 220° and 230° crank angle in order to initiate reservation of weft for the next cycle of weft insertion. In practice, a stroboscope is used to measure the moment at which the fourth coil of weft is unwound from the reservoir drum, and the pin drive unit 100 is set to drive the control pin P for advancement at a crank angle corresponding to the measured moment of unwind. In summary, the amount of weft necessary for one cycle of weft insertion is reserved by properly setting the length of period in which the control pin P is kept at the standby position out of engagement with the weft under delivery.

Assuming that weft insertion starts at TS° crank angle, terminates at TE° crank angle, and the number of coils of weft for one cycle of weft insertion is equal to N, unwinding of the fourth coil of the weft starts at $\{TS+(TE-TS)(N-1)/N\}°$ crank angle and terminates at TE° crank angle. As a consequence, the control pin P should be returned to the operative position at a moment between $\{TS+(TE-TS)(N-1)/N\}$ and TE° crank angles.

Figure 2:
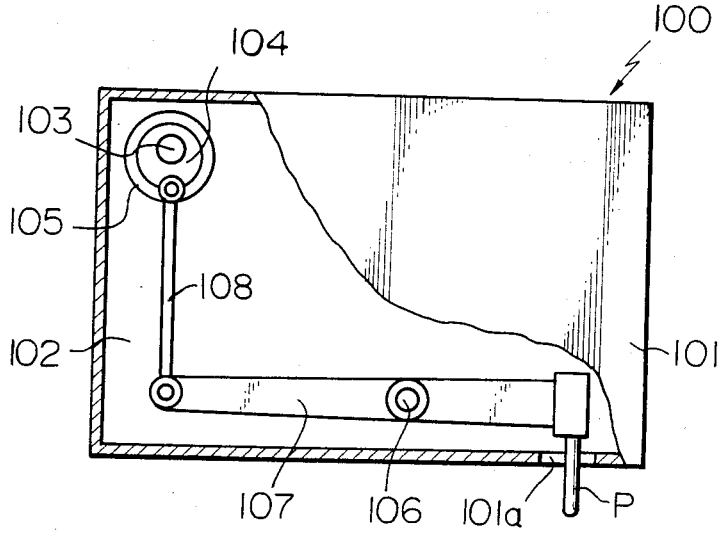
FIG. 2 is a side view of one embodiment of the pin drive unit used for the weft reservoir shown in FIG. 1.

The control pin P is driven for such a timed movement by operation of the pin drive unit 100 annexed to the reservoir drum 1 as shown in FIG. 1, and one embodiment of the pin drive unit 100 is shown in FIG. 2, in which a pulse motor is used for driving of the control pin P. More specifically, the pin drive unit 100 includes a housing 101 having a slot 101*a* formed in its wall facing the outer periphery of the reservoir drum 1 for free passage of the control pin P. A cam shaft 103 is rotatably mounted to the inner framework 102 of the pin drive unit 100 and operationally coupled to an output shaft of a pulse motor (not shown). The pulse motor is set to rotate over 180° each time the control pin should move from the stand-by to the operative position and vice versa. An eccentric cam 104 is secured to the cam shaft 103 while bearing a follower ring 105. A support shaft 106 is secured to the framework 102 and idly carries a swing lever 107. The swing lever 107 holds, at one end, the control pin P and is operationally coupled, at the other end, to the cam follower ring 105 by means of a connecting link 108. At every 180° rotation of the eccentric cam 104, the lever 107 swings about the support shaft 106 clockwise or counterclockwise in order to move the control pin P between the operative and stand-by positions. As the lever 107 swings clockwise as reviewed in FIG. 2, the control pin P advances from the stand-by to operative position for engagement with weft on the reservoir drum 1. Whereas, as the lever 107 swings counterclockwise, the control pin P recedes from the operative to the stand-by position out of engagement with the weft on the reservoir drum 1.

Figure 3:
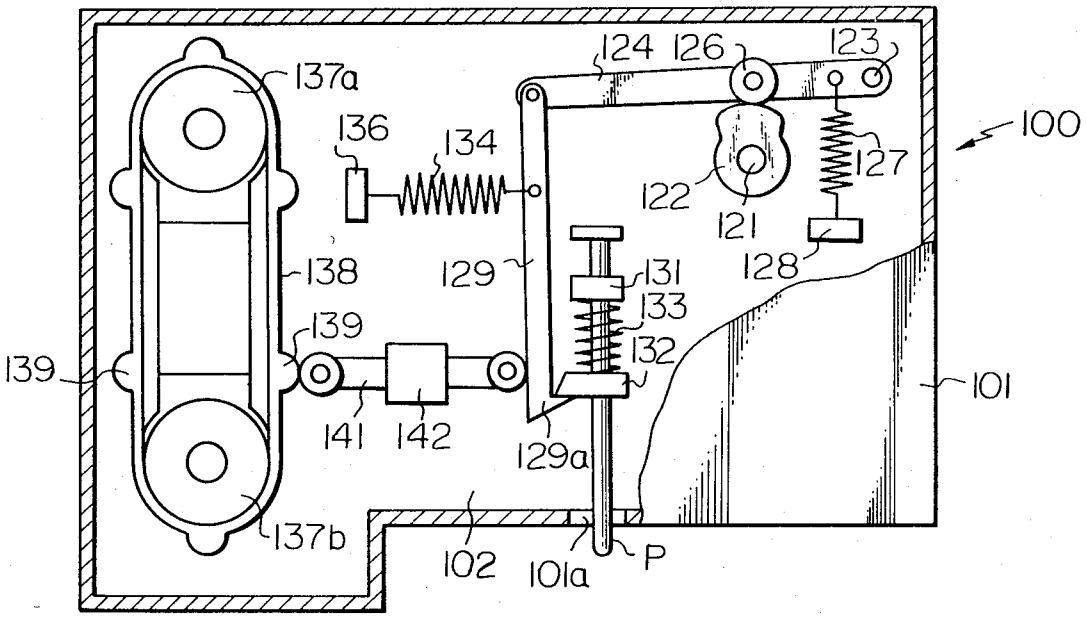
FIG. 3 is a side view of another embodiment of the pin drive unit used for the weft reservoir shown in FIG. 1.

Another embodiment of the pin drive unit 100 is shown in FIG. 3 in which a mechanical arrangement is used for causing the timed movement of the control pin P. Like the forgoing embodiment, the housing 101 is provided with the slot 101*a* on the side facing the outer periphery of the reservoir drum 1 for free passage of the control pin P. A cam shaft 121 is rotatably mounted to the inside framework 102 and operationally coupled to a proper drive motor (not shown) in order to perform one complete rotation per one complete rotation of the main drive shaft of the associated loom. A drive cam 122 is secured to the cam shaft 121. A support shaft 123 is secured to the framework 102 and pivotally carried one end of a swing lever 124. A cam follower 126 is rotatably mounted to the body of the swing lever 124 in resilient pressure contact with the drive cam 122 by assistance of a tension spring 127 interposed between the swing lever 124 and a spring seat 128 arranged on the framework 102. The other end of the swing lever 124 is pivoted to the top end of a hook lever 129 having a hook 129*a* at its lower end. The control pin P of this embodiment slidably extends through a guide 131 secured to the framework 102 and is provided, at a level corresponding to the hook 129*a* of the hook lever 129, with a fixed collar 132. A compression spring 133 is interposed between the guide 131 and the collar 132 surrounding the control pin P in order to resiliently press the control pin P towards its operative position on the outer periphery of the reservoir drum 1. A tension spring 134 is interposed between the body of the hook lever 129 and a spring seat 136 secured to the framework 102 in order to urge the hook 129*a* to move away from the collar 132 on the control pin P.

A pair of pulleys 137*a* and 137*b* are arranged for rotation in synchronism with the running loom and carry a selector 138 which is provided in the form of an endless belt having, at equal intervals, a number of surface bulges 139. A pusher rod 141 is slidably supported by a guide 142 secured to the framework 102 with one end in rolling contract with the back of the hook lever 129 and the other end facing the selector 138. The surface bulges 139 are arranged on the selector 138 so that one of them will come in contact with the end of the pusher rod 141 when the control pin P should be removed away from the operative position.

When the control pin P should be kept at the operative position, the bulges 139 on the selector 138 are out of contact with the end of the pusher rod 141 and the hook lever 129 swings about its top pivot by tension of the spring 134 so that its hook 129*a* should be kept out of engagement with the collar 132 on the control pin P which is now operationally disconnected from the cam drive system. As a consequence, the control pin P is kept at the operative position for engagement with weft on the reservoir drum 1 regardless of rotation of the drive cam 122.

At the very moment of weft delivery from the reservoir drum 1, one of the surface bulges 139 on the selector 138 comes in contact with the end of the pusher rod 141 which then pushes the hook lever 129 against tension of the spring 134 so that the hook 129*a* will come in engagement with the collar 132 on the control pin P. Now the control pin P is operationally connected to the cam drive system. As the drive cam 122 rotates, the lever 124 swings clockwise in the illustration about the support shaft 123 and, accordingly, the hook lever 129 lifts the control pin P via the collar-hook engagement so that the control pin P will be registered at the stand-by position out of engagement with weft to be delivered. After an amount of weft necessary for one cycle of weft insertion has been delivered, continued rotation of the drive cam 122 allows the control pin P to return to the operative position in engagement with the weft on the reservoir drum 1 and the control pin P is again operationally disconnected from the cam drive system by operation of the selector 138.

In accordance with the present invention, the amount of weft for one cycle of weft insertion is determined by the length of time in which the control pin P is kept at the stand-by position out of engagement with the weft under delivery. Weft on the continues to be delivered to the reservoir drum 1 during the above-described period. As long as the loom is operated normally, the operation of the control pin P is correctly timed to allow controlled delivery of the weft. When the loom ceases running for some unexpected reasons at the very moment of weft insertion, the control pin P is brought to the stand-by position and kept there even after the moment at which it should be returned to the operative position. In other words, delivery of weft continues even after the amount of weft necessary for one cycle of weft insertion has already been delivered, and this delivery continues until all coils of weft on the reservoir drum have been delivered, since the operation of the pin drive unit 100 is synchronized with the running of the loom which has already stopped.

In order to avoid this inconvenience, another embodiment of the present invention employs an auxiliary control pin P′ accompanying the main control pin P. When the loom has ceased its normal operation, the auxiliary control pin P′ is brought into contact with the outer periphery of the reservoir drum 1 in order to block the weft against delivery from the reservoir drum 1. During normal operation of the loom, the auxiliary control pin P′ is kept out of contact with the reservoir drum 1 in order to pass the weft over to the sole control by the main control pin P. Operation of such an auxiliary control pin P′ can be either manually or automatically controlled.

Figure 4:
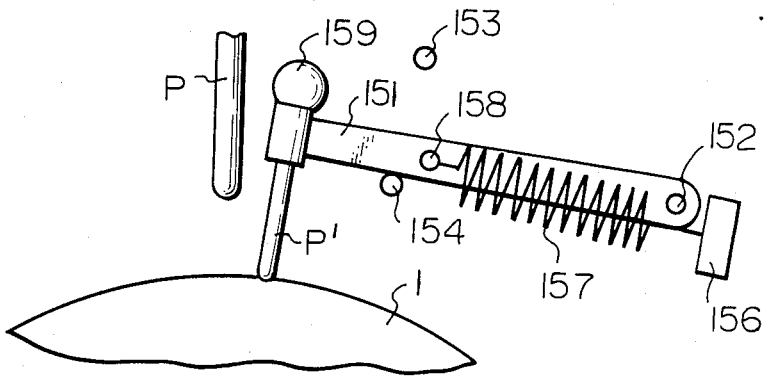
FIG. 4 is a side view of the other embodiment of the pin drive unit provided with an auxiliary control pin for restricting excessive delivery of weft.

On embodiment of the manual control to this end is shown in FIG. 4, in which a swing lever 151 is pivoted at one end to a support shaft 152 and securedly holds at the other end the auxiliary control pin P′ in the vicinity of the main control pin P. A pair of stoppers 153 and 154 are arranged on both vertical sides of the swing lever 151 while being properly spaced from each other. A fixed spring seat 156 is arranged near the support shaft 152 for the lever 151 and a tension spring 157 is interposed between the spring seat 156 and a pin 158 fixed to the body of the lever 151. The position of the fixed spring seat 156 is chosen so that, when the swing lever 151 is in contact with the lower stopper 154 and the auxiliary control pin P′ is placed in contact with the reservoir drum 1, the axial line of the tension spring 157 should be located slightly below a straight line connecting the centers of the pin 158 and the support shaft 152 whereas, when the swing lever 151 is in contact with the upper stopper 153 and the auxiliary control pin P′ is kept out of contact with the reservoir drum 1, the axial line of the tension spring 157 should be located above the above-described straight line.

When the loom has stopped its normal operation, the lever 151 is manually pushed towards the reservoir drum 1 via a knob 159. Then, the spring 157 acts to urge the lever 151 to swing counterclockwise in the illustration about the support shaft 152 so that the auxiliary control pin P′ is kept in contact with the outer periphery of the reservoir drum 1 even after the manual action on the knob 159 has been removed. When normal operation of the loom reinstated, the lever 151 is manually pulled away from the reservoir drum 1 via the knob 159. Then, the axial line of the spring 157 comes above the straight line between the pin 158 and the support shaft 152 and the spring 157 acts to urge the lever 151 to swing clockwise about the shaft 152 so that the auxiliary control spring P′ is kept out of contact with the outer periphery of the reservoir drum 1 even after the manual action on the knob 159 has been removed.

Alternatively, it is also possible to provide the main control pin P with the above-described function of the auxiliary control pin P′ without using such a separate auxiliary control pin P′. In this case, a servo-motor is used for control of the operation of the control pin P. More specifically, such a servomotor is accompanied with an electric circuit including a manual switch which, when the loom has stopped its normal running, actuates the motor to bring the control pin into contact with the outer periphery of the reservoir drum.

We claim:

1. A weft reservoir for fluid jet looms on which weft is reserved and delivered under pin control, said weft reservoir comprising:

a reservoir drum including an upstream side conical section converging downstream and a downstream side cylindrical section;

a yarn guide annexed to said reservoir drum for supplying weft taken from a given source of supply through relative rotation between said yard guide and said reservoir drum;

a control pin annexed to said reservoir drum with its point being directed to an operative position on the outer periphery of said reservoir drum on the downstream side of said cylindrical section; and means for keeping said control pin at a stand-by position away from said operative position over a period of time corresponding to the time it takes for a length of weft required for a single weft insertion to be removed from said reservoir.

2. A weft reservoir as claimed in claim 1 in which said keeping means includes a pin drive unit including a cam drive system synchronized with the loom running.

3. A weft reservoir as claimed in claim 2 in which said pin drive unit further includes means for selectively disconnecting said control pin from said cam drive system when said control pin should be kept at said operative position.

4. A weft reservoir as claimed in claim 3 in which said cam drive system includes a drive cam synchronized with the loom running, and a link assembly for operationally connecting said drive cam to said control pin, and said disconnecting means includes a selector for selectively disconnecting said link assembly from said control pin.

5. A weft reservoir as claimed in claim 1 further comprising means for barring accidental slip-out of weft at delivery from said reservoir drum and arranged on the downstream side of said cylindrical section of said reservoir drum.

6. A weft reservoir as claimed in claim 5 in which said barring means includes a conical section diverging downstream of said reservoir drum.

7. A weft reservoir as claimed in claim 5 in which said barring means includes at least one annular brush arranged surrounding the downstream end of said cylindrical section of said reservoir drum.

8. A weft reservoir as claimed in claim 5 in which said barring means includes a cover for defining a confined annular chamber around the downstream end of said cylindrical section of said reservoir drum, and means for generating compulsory pneumatic flow within said annular chamber, thereby pressing said weft under delivery against the outer periphery of said reservoir drum.

9. A weft reservoir as claimed in claim 1 further comprising means for restricting delivery of weft in excess of the amount necessary for one cycle of weft insertion when the loom has ceased its normal running.

10. A weft reservoir as claimed in claim 9 in which said restricting means includes an auxiliary control pin annexed to said reservoir drum near said control pin, and means for placing said auxiliary control pin in contact with the outer periphery of said reservoir drum when the loom has ceased its normal running.

11. A weft reservoir as claimed in claim 1, wherein said period of time is equal to the time it takes for a length of weft required for a single weft insertion to be removed from said reservoir.

* * * * *